US011220389B1

(12) United States Patent
Lindberg et al.

(10) Patent No.: US 11,220,389 B1
(45) Date of Patent: Jan. 11, 2022

(54) FRAGILE GLASS PROTECTIVE PACKAGING SYSTEM

(71) Applicant: Amazon Technologies, Inc., Seattle, WA (US)

(72) Inventors: Brent Lindberg, Gallatin, TN (US); Brent Stephen Nelson, Seattle, WA (US); Kyle Jeffrey Jacob Lindenman, Elgin, IL (US); Jae Jeon, Des Plaines, IL (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 17/034,423

(22) Filed: Sep. 28, 2020

(51) Int. Cl.
*B65D 85/30* (2006.01)
*B65D 81/05* (2006.01)
*B31C 99/00* (2009.01)

(52) U.S. Cl.
CPC ..... *B65D 81/05* (2013.01); *B31C 13/00* (2013.01); *B65D 85/30* (2013.01); *B65D 2581/053* (2013.01)

(58) Field of Classification Search
CPC ..... B65D 71/40; B65D 71/46; B65D 81/05; B65D 85/30; B65D 2581/053; B65D 81/025; B65D 81/053; B65D 5/5035; A47G 23/0208; A45C 2200/20
USPC ..... 206/426, 521, 418
See application file for complete search history.

(56) References Cited

U.S. PATENT DOCUMENTS 3,782,621 A * 1/1974 Edgeington, Jr. .... B65D 5/5038 206/418
3,931,888 A * 1/1976 Fogel ..... B65D 71/16 206/434
6,336,556 B1 * 1/2002 Gale ..... B65D 5/4804 206/193

* cited by examiner

*Primary Examiner* — Steven A. Reynolds
(74) *Attorney, Agent, or Firm* — Klarquist Sparkman, LLP

(57) ABSTRACT

An insert made of corrugated paper is easily assembled, uses no glue, allows shipping of glass, such as stemware, in any orientation, reduces packing material and reduces shipping costs. In addition, customers receiving the glass can easily unpack the glass and reuse the insert for storing the glass, as the insert can be opened and closed without ripping. The insert has multiple cutouts matching a profile of a bowl of the glass. U-shaped channels are formed by folding the insert along scored lines. The U-shaped channels maintain the glass away from a side of a box in which the insert is placed. The edges of the corrugated paper along the multiple cutouts envelope the bowl of the glass and remove weight and any potential shock that can be transmitted to the glass.

15 Claims, 8 Drawing Sheets

FRAGILE GLASS PROTECTIVE PACKAGING SYSTEM

BACKGROUND

Wine glasses, champagne glasses, goblets, etc. are more generally classified as stemware. Stemware has three parts, a bowl, which holds a drink, a foot or base, which allows the stemware to stand, and a decorative stem between the bowl and foot. There are numerous problems with shipping stemware. Typically, when stemware breaks during shipping, it breaks along the stem, which is not only the weakest part of the glass but carries the weight of the bowl. Additionally, any impact to the bowl or foot is transferred to the stem, compounding the likelihood of breakage. The industry solution to stemware-transit damage is to overpack the stemware in large boxes with excessive padding. Of course, larger boxes have increased shipping costs and customers are becoming increasingly frustrated with throwing away large amounts of bubble wrap and other earth-unfriendly packing material. A shipping solution is needed for stemware that is compact and requires less packing material.

DETAILED DESCRIPTION

Shipping of stemware has been problematic in the past due to ease of breakage. Stickers indicating "fragile" or "this end up" have been ineffective as boxes are often thrown onto trucks or shipping containers and stacked in whatever orientation fits best. The disclosed stemware insert is easily assembled, uses no glue, allows shipping in any orientation, reduces packing material, and reduces shipping costs. In addition, customers receiving the stemware can easily unpack the stemware and reuse the insert for storing the stemware, as the insert can be opened and closed without tearing.

The stemware insert is made of corrugated paper and has multiple cutouts matching a profile of a bowl and base of the stemware. U-shaped channels are formed by folding the insert along scored lines. The U-shaped channels maintain the stemware away from a side of a box in which the insert is placed. The edges of the corrugated paper along the multiple cutouts envelope the bowl and base of the stemware and remove weight and any potential shock that can be transmitted to the stem of the stemware.

Corrugated paper (more generically called "cardboard") is packing material made of layers of paper, wherein some of the layers are alternately grooved and ridged for added rigidity and strength. The corrugated paper has a direction of corrugation along which the corrugated paper is easily folded. For example, the corrugated paper can be single wall having a single layer of flutes or double-walled having a double layer of flutes. The direction of corrugation is parallel to the flutes making it easy to fold along the flutes but difficult to crush in the direction of the flutes.

Figure 1:
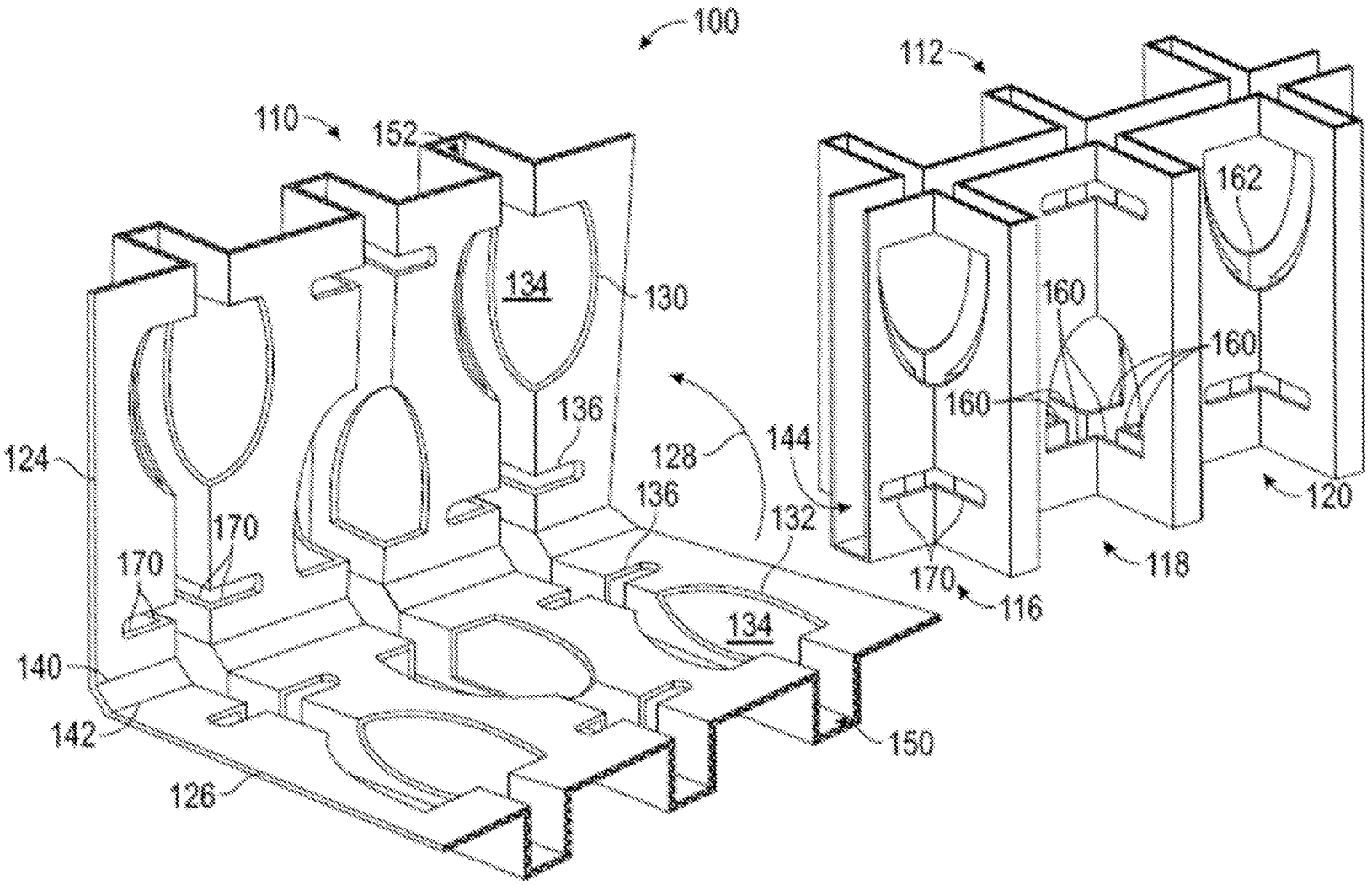
FIG. 1 shows an assembled stemware shipping insert in an open and closed position.
Figure 5:
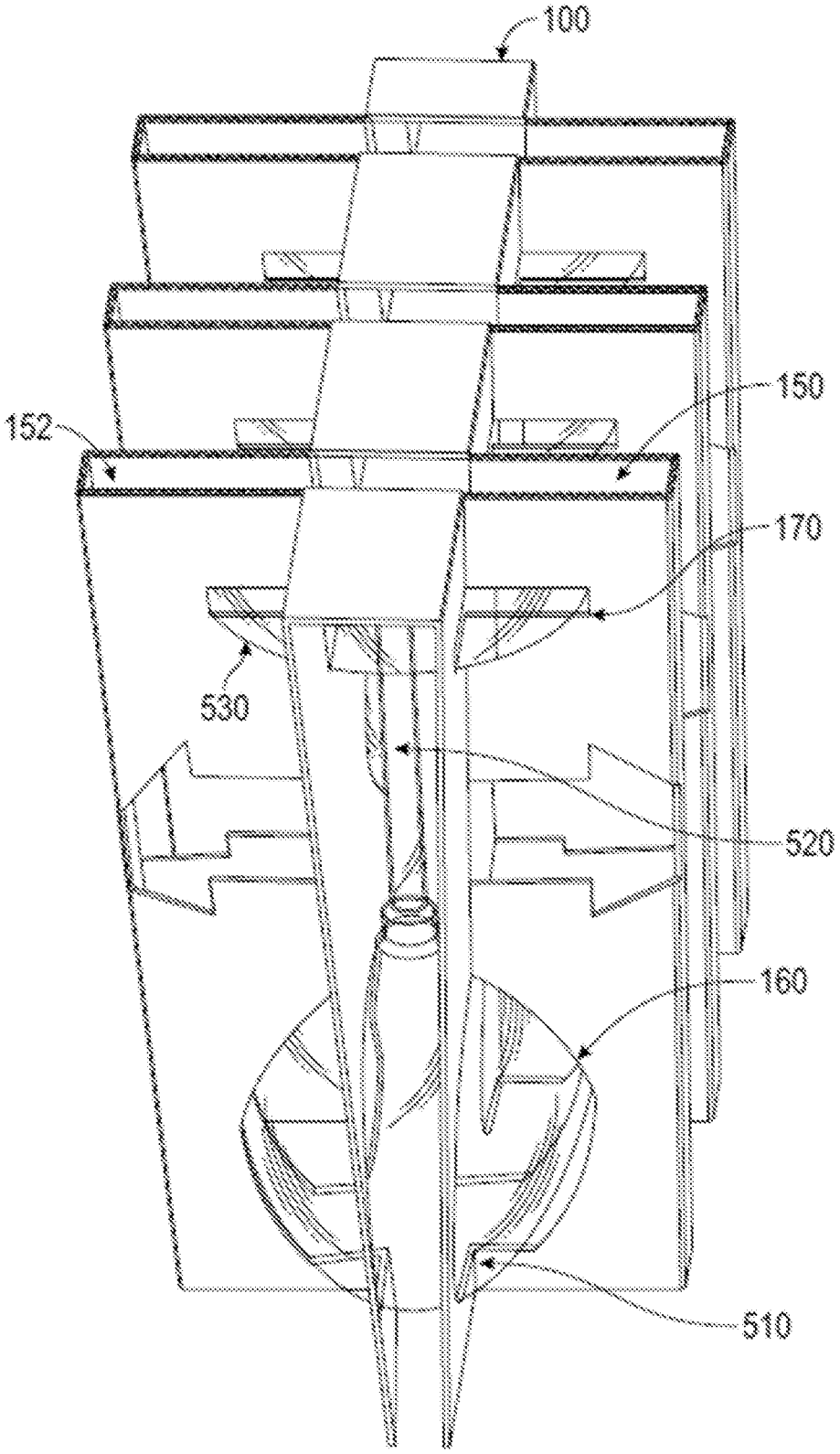
FIG. 5 shows the shipping insert with wine glasses inserted therein.
Figure 6:
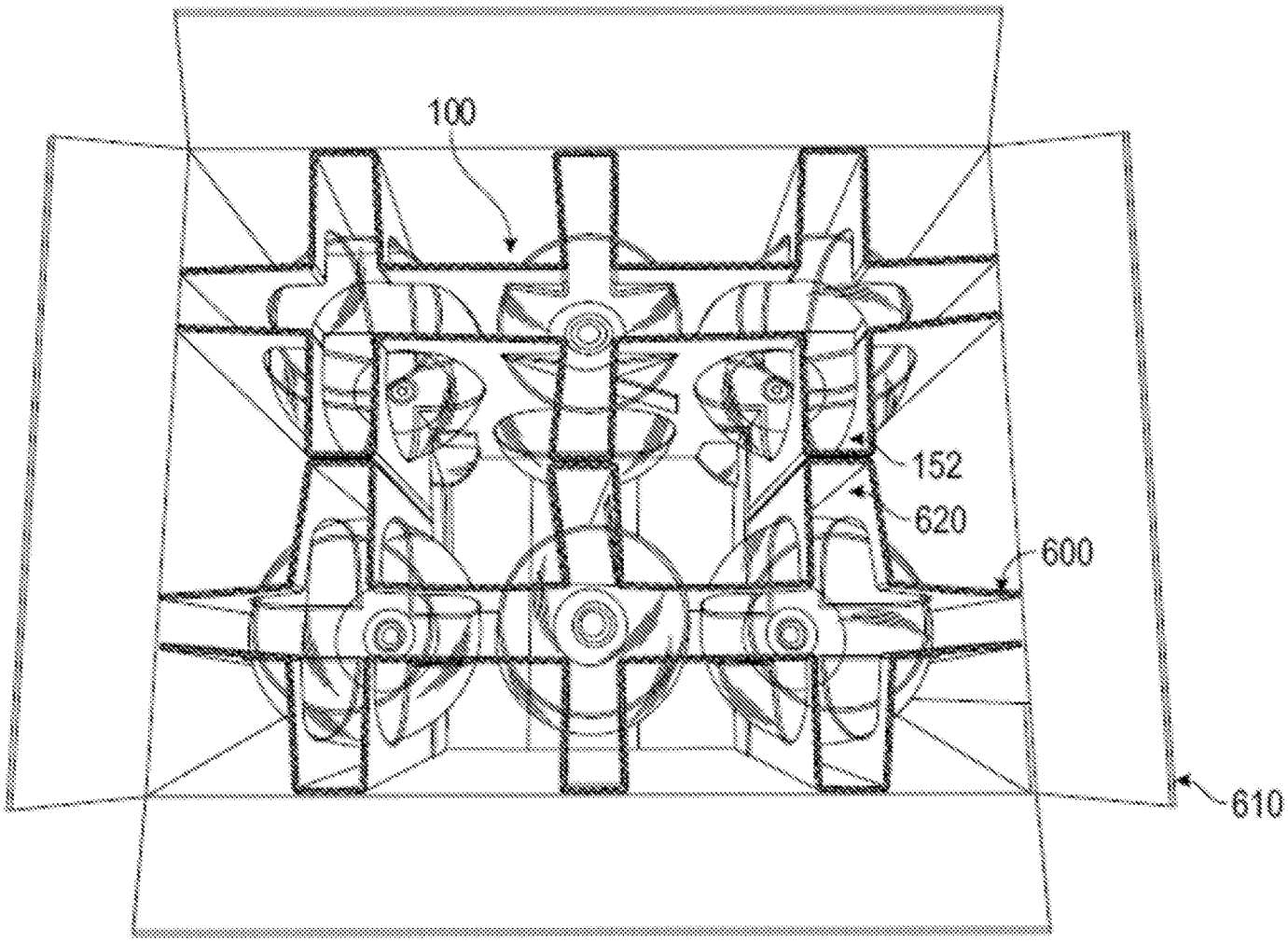
FIG. 6 shows two shipping inserts assembled with wine glasses in a box.

FIG. 1 illustrates a stemware insert 100 in an open position shown at 110 and a closed position shown at 112. No glasses are shown in FIG. 1, but FIGS. 5 and 6 show the insert 100 with glasses mounted therein. The insert 100 is designed to hold three glasses, which in this case are wine glasses, but any stemware glasses can be used. Additionally, while the design is shown only for three glasses, the insert can be extended to any number of desired glasses or reduced to carry one or two glasses. The three glass positions are shown at 116, 180 and 120. Notably, every alternating glass is in an inverted orientation. For example, glasses in positions 116 and 120 are upright, while a glass held in position 118 is inverted or upside down.

The insert 100 has a top half 124 and a bottom half 126. During assembly, the glasses can be placed into the bottom half 126 and then the insert 100 is folded closed as indicated by arrow 128. Each of the top half 124 and the bottom half 126 includes mirrored cutouts 130, 132 that align in the closed position 112 to support the glass. Additionally, each of the mirrored cutouts 130, 132 includes a bowl cutout 134 and a base cutout 136. In order to fold from the open position 110 to the closed position 112, two score lines 140, 142 run horizontally between the top half 124 and bottom half 126. The spacing between the score lines 140, 142 define a width of a U-shaped channel 144 extending along a bottom of the insert 100.

The insert 100 further includes two U-shaped channels 150, 152 per glass that extend along an axis of the glass. As shown in the closed position 112, the U-shaped channels 150, 152 together with the cutouts 134 create eight radially-extending corrugated paper edges, as shown at 160. The corrugate paper edges 160 support a top of the glass. However, due to the bowl cutouts 134, the corrugate paper edges also extend radially outward from a bottom of the glass (see 162) along a profile of the glass. The eight radially-extending edges 162, starting from a bottom of the glass and extending up a profile of the glass, support a weight of the glass and reduce or eliminate any pressure, such as weight transfer or shock, from the bowl to a stem of the glass. In a similar fashion, the base cutouts 136, in the closed position 112, form eight corrugated edges 170 along a bottom of the base and a top of the base such that the weight or any shock to the base is not transferred to the stem of the glass. Corrugation flutes are shown as extending along a direction of the channels 150, 152 and along the axis of the glasses. Although FIG. 1 is an example embodiment focused on stemware, the insert 100 can be adapted to glass that does not include a stem.

Figure 2:
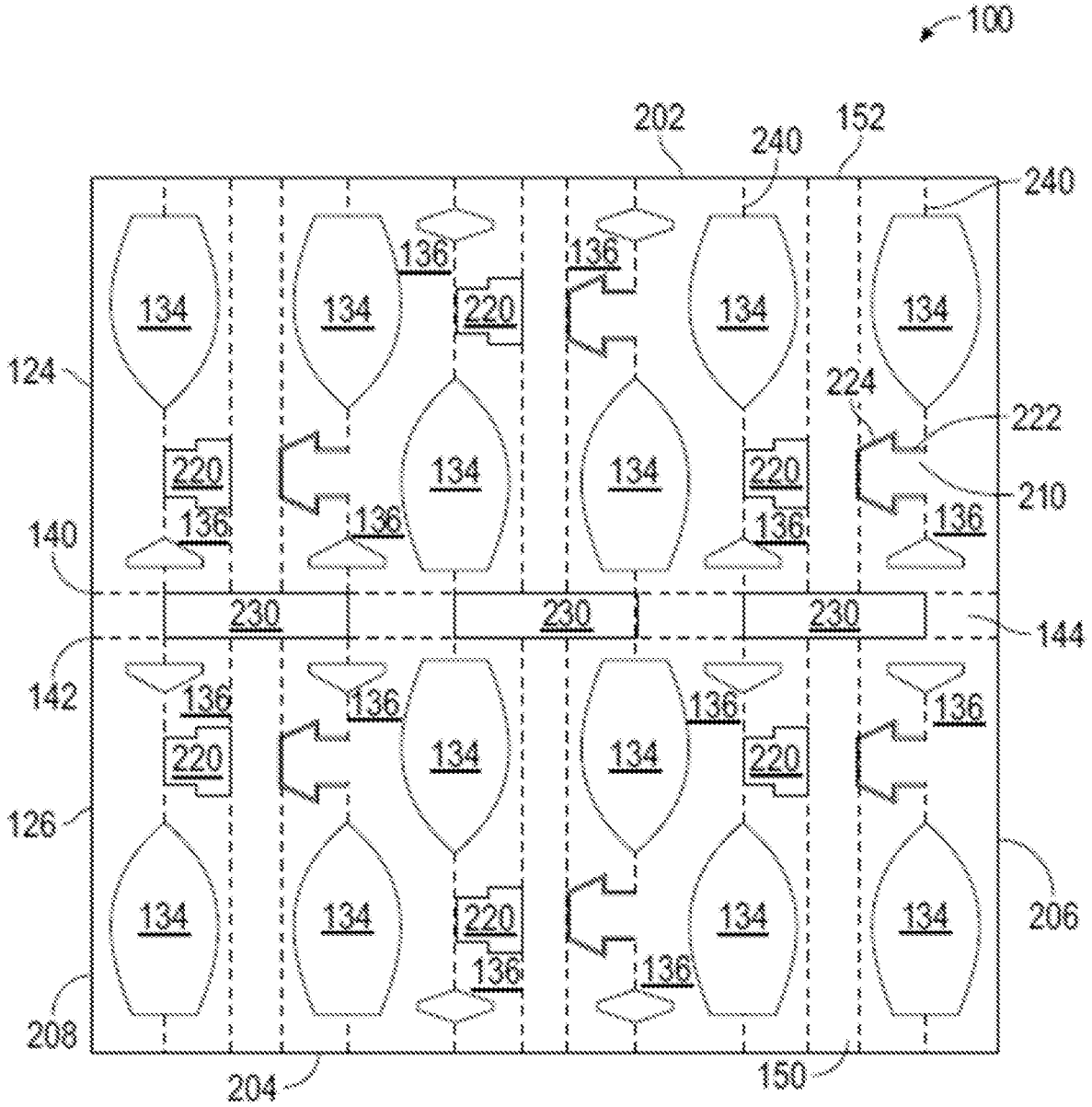
FIG. 2 shows a cardboard blank used for assembling the shipping insert of FIG. 1.

FIG. 2 shows a blank of the stemware insert 100 in a flat configuration. Numbers that are underlined in FIG. 2 emphasize that the corrugated insert is cutout in that section. The stemware insert 100 is a single, monolithic piece of corrugated paper (a cardboard blank) that has a top end 202, a bottom end 204, and opposing sides 206, 208. The dashed lines indicate where the insert 100 is scored to facilitate folding. The score lines can be made using cuts in the insert 100, blunt compression or any other desired technique. Once the insert is folded along the vertical dashed lines, tabs 210 are used to maintain the insert 100 in the folded position. More specifically, the tabs 210 are inserted into receptacle cutouts 220. The tabs include an elongated neck portion 222 and a barbed head 224 that locks the tab 210 into the receptacle. In order to allow the U-shaped channels 150, 152 to be easily formed, cutouts 230 are made in the U-shaped channel 144. Notably, each glass is formed from four bowl-shaped cutouts 134, one on each side of the U-shaped channel 150 and one on each side of the U-shaped channel 152. A horizontal axis is formed halfway between the score lines 140, 142, which extends between the opposing sides 206, 208. Additionally, score lines 240 extend along a vertical axis of each cutout 134. When the top half 124 and bottom half 126 are folded together about the horizontal axis, the bowl and base cutouts from each half align and create multiple corrugated edges extending along a profile of the base and the bowl of a glass placed within the insert. Although not shown, the corrugation flutes extend between the top end 202 and the bottom end 204.

Figure 3:
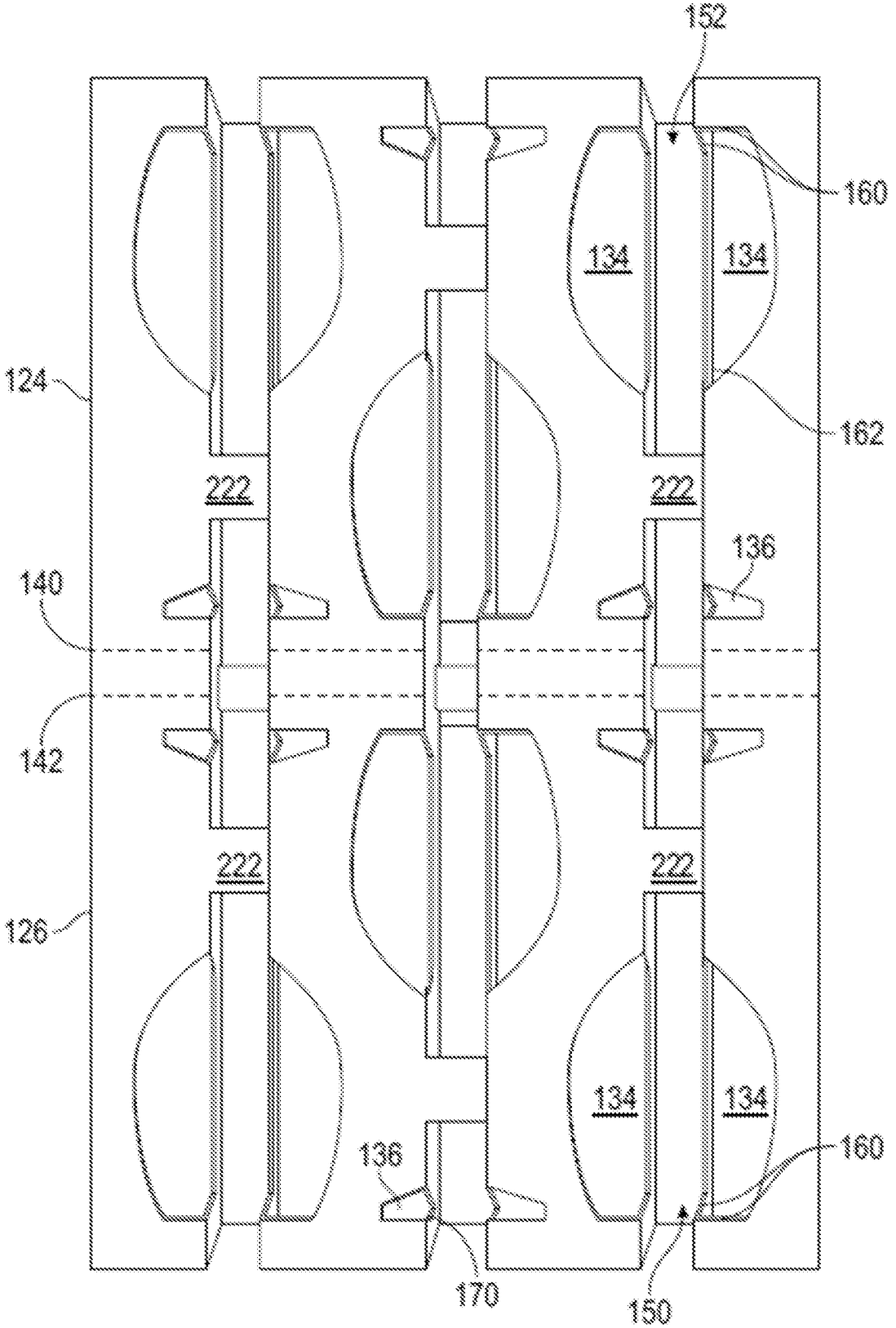
FIG. 3 is the cardboard blank of FIG. 2 folded to create U-shaped channels as seen from a front view.

FIG. 3 is a front-perspective view of the stemware insert 100 in an open position. The neck portion 222 of the tab 210 is visible with the tabs 210 inserted into the receptacle cutouts 220 (not visible in this figure). The U-shaped channels 150, 152 create two corrugated edges 160 per cutout 134 that extend radially outward from a top of the bowl cutout 134 and two corrugated edges 162 per cutout that extend radially outward from a bottom the bowl cutout 134. When the bottom half 126 is folded along score lines 140, 142 to mate with the top half 124, eight corrugated edges are formed that envelope the bowl to isolate the bowl from the stem in terms of shock absorption and weight. Likewise, the corrugated edges 170 formed by the base cutout 136 envelope a top and bottom of a base of the glass to isolate the base from the stem to reduce or eliminate shock absorption and weight.

Figure 4:
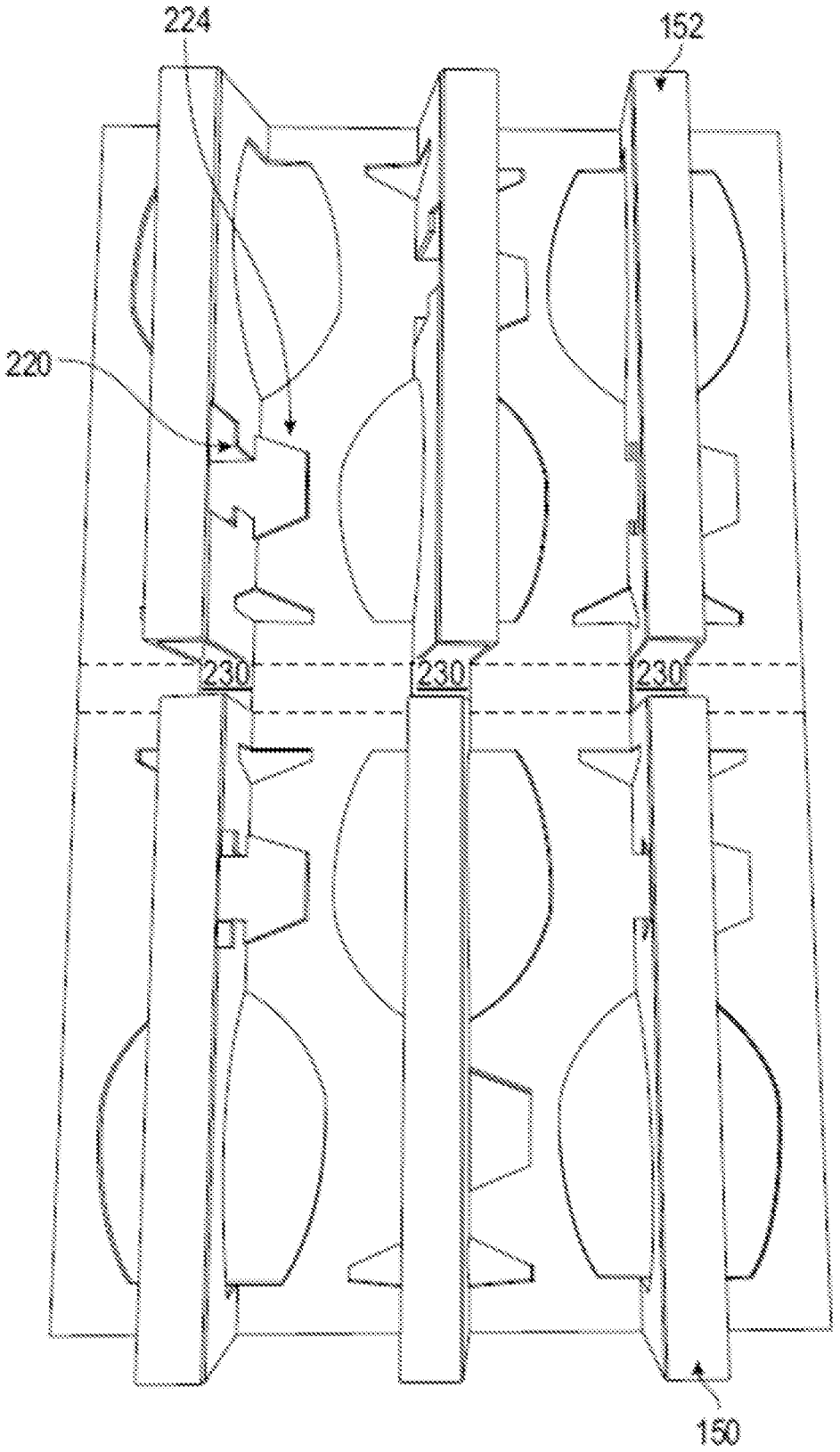
FIG. 4 is the cardboard blank of FIG. 2 folded to create U-shaped channels as seen from a back view.

FIG. 4 is a back-perspective view of the stemware insert 100 in the open position. In this view, the neck portion 222 of the tab 210 is not visible, but the barbed head 224 is shown locked into the receptacle cutouts 220. The U-shaped channels 150, 152 extend outwardly and perpendicularly from the insert 100 and protect the stemware from side impacts, as is seen in the assembled view of FIG. 6. The U-shaped channels 150, 152 have some lateral flexibility along the fold lines, but are otherwise resilient to crushing along the direction of the corrugation.

FIG. 5 shows the insert 100 with glasses 510 inserted therein. The cutouts 134 allow edges 160 to extend along the profile of the glass 510 and remove weight from a stem 520. Likewise, edges 170 formed by cutout 136 remove any weight of a base 530 from the stem 520. The tabs 210 and receptacle cutouts 220 ensure that no glue is needed.

FIG. 6 shows the insert 100 aligned with a second insert 600 in a box 610. In the packed configuration, the U-shaped channel 152 aligns with an opposing U-shaped channel 620 of insert 600. Similarly, each glass in insert 100 has a U-shaped channel associated therewith that aligns with a corresponding U-shaped channel of insert 600 to maintain the glasses at a safe distance and to protect the glasses from forces within the box. Each alternating glass is inverted from an adjacent glass such that there is no top or bottom of the box 610.

Figure 7:
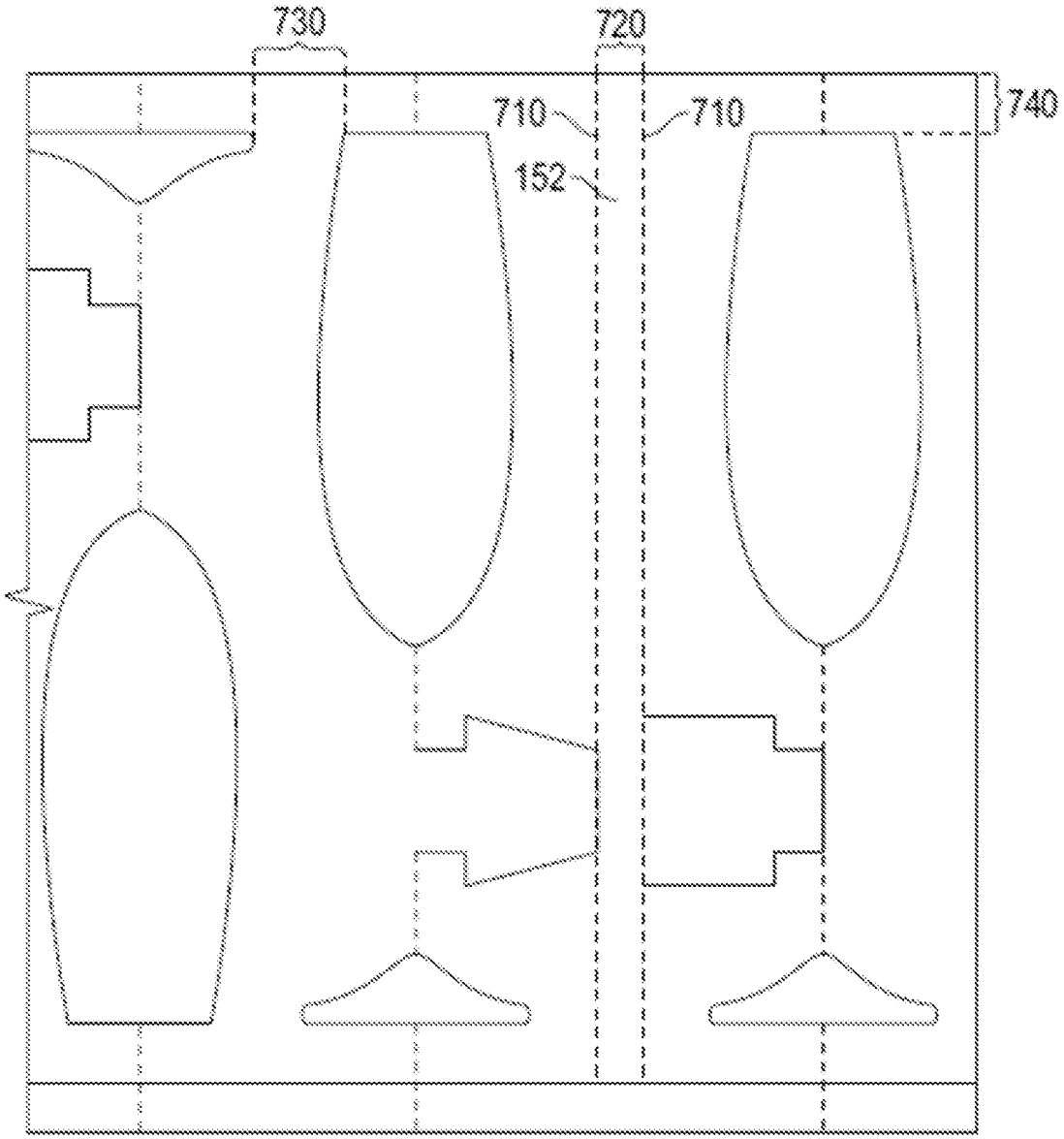
FIG. 7 illustrates dimensions that can be used for the cardboard blank of FIG. 2.

FIG. 7 shows example measurements that can be used for the insert 100. The U-shaped channel 152 is defined by score lines 710. Generally, the score lines 710 are a distance apart 720 that is approximately ⅓ of the diameter of the bowl of the glass (at its widest point). By "approximately" it is meant that a 10% variance can be used. Alternatively, the distance 720 can be approximately ⅓ of the diameter of the smaller of the bowl or the base. A distance 730 between the glasses can be 1" or greater to ensure adequate separation between glasses. A distance 740 between the top of the cutout and the top of the insert can be 11/16". A similar distance can be used between the bottom of the base cutout and the bottom of the insert.

Figure 8:
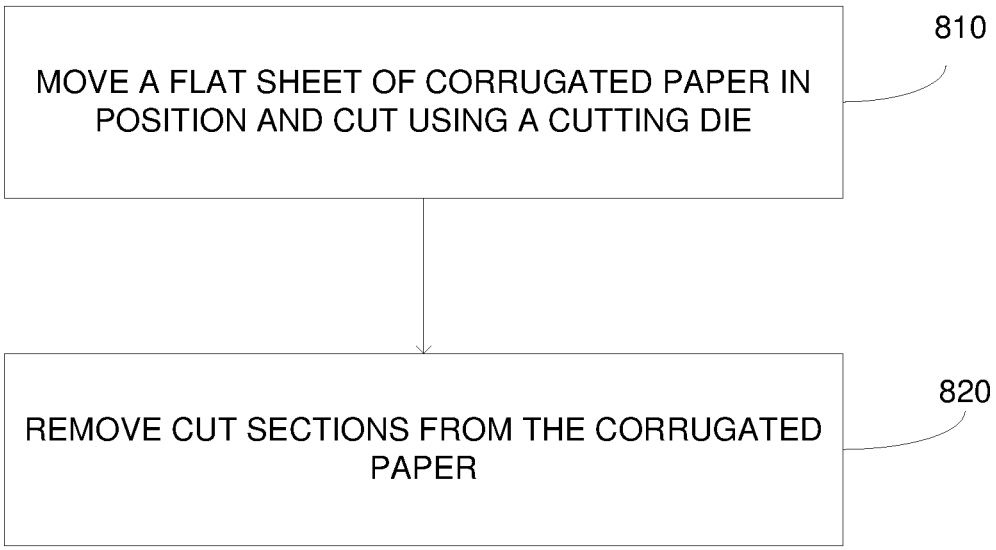
FIG. 8 is a flowchart according to one embodiment for manufacturing the insert.

FIG. 8 is a flowchart of manufacturing an insert according to one embodiment. In process block 810, a single monolithic sheet of corrugated paper is used, which is sized to fit in a desired box. A cutting die is configured to prepare the insert by cutting and scoring the insert as described above. The cutting die includes blades for cutting sections of cardboard that match a profile of an outer edge of a bowl of the glass. Four bowl cutouts per glass are made in the sheet of corrugated paper. For example, in FIG. 2, four bowl cutouts are created per glass matching a profile of the bowl, which are shown generically at 134. In FIG. 2, the four bowl cutouts on the right-most part of the figure represent the four cutouts associated with one glass. Additionally, the cutting die is configured to score two lines on a top portion of the corrugated paper and two lines on the bottom portion of the corrugated paper. For example, the score lines that define channels 150, 152 are made between the bowl cutouts. The score lines can also be seen in FIG. 7 at 710. In addition, the cutting die is configured to cut four base cutouts from the corrugated paper. For example, in FIG. 2, the four base cutouts 136 on either side of channels 150, 152 are cutout. Finally, the cutting die is configured to score the corrugated paper along two lines perpendicular to the previously-described score lines. For example, score lines 140 and 142 are perpendicular to the score lines defining channels 150, 152. When folded, the first score lines are configured to form first and second U-shaped channels (e.g., 150, 152) whereas the score lines 140, 142 create a third channel (e.g., 144) perpendicular to the first two channels. In process block 820, the cut sections from process block 810 are removed to generate the final insert.

The disclosed methods, apparatus, and systems should not be construed as limiting in any way. Instead, the present disclosure is directed toward all novel and nonobvious features and aspects of the various disclosed embodiments, alone and in various combinations and subcombinations with one another. The disclosed methods, apparatus, and systems are not limited to any specific aspect or feature or combination thereof, nor do the disclosed embodiments require that any one or more specific advantages be present or problems be solved.

In view of the many possible embodiments to which the principles of the disclosed invention may be applied, it should be recognized that the illustrated embodiments are only examples of the invention and should not be taken as limiting the scope of the invention. We therefore claim as our invention all that comes within the scope of these claims.

What is claimed is:

1. An insert for shipping stemware having a bowl, a base, and a stem between the bowl and the base, comprising:

a single piece of corrugated paper having top and bottom ends and opposing sides and a horizontal axis extending between the opposing sides to form a top half and bottom half of the corrugated paper;

the corrugated paper having tabs formed therein and cutouts forming receptacles for receiving the tabs, such that when the tabs are inserted into the receptacles a U-shaped channel is formed extending from the top to the bottom ends;

the corrugated paper further including a first set of bowl cutouts matching a profile of the bowl of the stemware on opposite sides of the U-shaped channel on the top half and a second set of bowl cutouts matching the profile of the bowl of the stemware on opposite sides of the U-shaped channel on the bottom half of the corrugated paper, the first set of bowl cutouts and the second set of bowl cutouts aligning when the corrugated paper is folded about the horizontal axis; and the corrugated paper further including a first set of base cutouts matching a profile of the base of the stemware on opposite sides of the U-shaped channel on the top half and a second set of base cutouts matching the profile of the base of the stemware on opposite sides of the U-shaped channel on the bottom half of the corrugated paper, the first set of base cutouts and the second set of base cutouts aligning when the corrugated paper is folded about the horizontal axis;

wherein the first and second sets of bowl cutouts are designed to receive the bowl of the stemware allowing the corrugated paper to support the bowl by contacting both a bottom surface and a top surface of the bowl and the first and second sets of base cutouts are designed to receive the base of the stemware allowing the corrugated paper to support, through contact, both a bottom and a top surface of the base, such that at least some of the weight of the bowl or base is supported by the corrugated paper when the insert is assembled, wherein first and second sets of bowl cutouts are sized differently than the first and second sets of base cutouts.

2. The insert of claim 1, wherein the first set of bowl cutouts and the second set of bowl cutouts, when aligned, create eight sections of the corrugated paper extending along a profile of the bowl.

3. The insert of claim 1, wherein the first and second sets of bowl cutouts are aligned to orient a first stemware from the top to the bottom and wherein the insert includes third and fourth sets of bowl cutouts to align a second stemware from the bottom to the top.

4. The insert of claim 1, further including corrugation flutes in the corrugated paper, wherein the corrugation flutes extend from the top end to the bottom end.

5. The insert of claim 1, wherein a width of the U-shaped channel is substantially ⅓ of a diameter of the bowl.

6. An insert for glass transit, comprising:

a piece of corrugated paper having at least first and second bowl cutouts matching a profile of a bowl of glass, wherein the first bowl cutout is on a top half of the corrugated paper and the second bowl cutout is on a bottom half of the corrugated paper and the corrugated paper is configured to fold so the first and second bowl cutouts align;

tabs formed in the corrugated paper and receptacle cutouts in the corrugated paper designed to receive the tabs, wherein the corrugated paper is configured to fold when the tabs are inserted in the receptacle cutouts to form a U-shaped channel extending from a top of the corrugated paper to a bottom of the corrugated paper;

wherein the corrugated paper is configured to support a weight of the bowl of the glass along an edge of the corrugated paper associated with the first and second bowl cutouts, wherein the first and second bowl cutouts are configured to contact a top rim of the bowl of the glass using a first edge of the corrugated paper and a bottom of the bowl of the glass using a second edge of the corrugated paper.

7. The insert of claim 6, further including third and fourth bowl cutouts on an opposite side of the U-shaped channel from the first and second bowl cutouts, respectively.

8. The insert of claim 7, wherein the third and fourth bowl cutouts cooperate with the first and second bowl cutouts and the U-shaped channel to provide 8 edges of the corrugated paper to support the bowl.

9. The insert of claim 6, wherein the U-shaped channel has a width that is substantially ⅓ a diameter of the bowl.

10. The insert of claim 6, wherein the piece of corrugated paper is configured to hold a first glass in the first and second bowl cutouts, and wherein the first glass is positioned upright from the top of the corrugated cardboard to the bottom and wherein the corrugated paper is configured to hold a second glass adjacent the first glass, the second glass being inverted with respect to the first glass.

11. The insert of claim 6, wherein flutes formed in the corrugated paper extend from the top of the corrugated cardboard to the bottom, along a same direction as an axis of a glass held by the first and second bowl cutouts.

12. The insert of claim 6, further including a first base cutout in the top half of the corrugated paper and a second base cutout in the bottom half of the corrugated paper, wherein the first base cutout and the second base cutout align when the corrugated paper is folded, wherein the first and second base cutouts are sized differently than the first and second bowl cutouts.

13. The insert of claim 12, wherein the glass is stemware and edges of the corrugated paper at the first and second base cutouts reduce pressure from a base on a stem of the glass and edges of the corrugated paper at the first and second bowl cutouts reduce pressure from the bowl on the stem of the glass.

14. The insert of claim 6, wherein when the corrugated paper is folded, the U-shaped channel includes first and second U-shaped channels extending on opposing sides of the bowl of the glass.

15. The insert of claim 14, further including a third U-shaped channel extending perpendicular to the first and second U-shaped channels.

* * * * *